US012599829B1

(12) United States Patent
Propper et al.

(10) Patent No.: US 12,599,829 B1
(45) Date of Patent: Apr. 14, 2026

(54) GOLF SWING TRAINING AID

(71) Applicants: Robert Propper, Riverview, FL (US); Stacy N Keisler, Land O'Lakes, FL (US)

(72) Inventors: Robert Propper, Riverview, FL (US); Stacy N Keisler, Land O'Lakes, FL (US)

( * ) Notice: Subject to any disclaimer, the term of this patent is extended or adjusted under 35 U.S.C. 154(b) by 375 days.

(21) Appl. No.: 18/524,593

(22) Filed: Nov. 30, 2023

(51) Int. Cl.
*A63B 69/36* (2006.01)

(52) U.S. Cl.
CPC ..... *A63B 69/3667* (2013.01)

(58) Field of Classification Search
CPC ..... A63B 69/3667
USPC ..... 473/150, 160, 218, 270, 278, 279
See application file for complete search history.

(56) References Cited

U.S. PATENT DOCUMENTS 3,658,344 A * 4/1972 Kimble ..... A63B 69/3667 473/272
4,023,810 A * 5/1977 Lorang ..... A63B 69/3673 473/218
4,805,913 A * 2/1989 Bott ..... A63B 69/3667 473/270
4,915,387 A * 4/1990 Baxstrom ..... A63B 69/36 473/270
5,108,106 A * 4/1992 Cook ..... A63B 69/3667 473/272
5,275,570 A * 1/1994 Hicks ..... A63B 69/3667 434/252
7,186,184 B2 * 3/2007 Buck ..... A63B 69/3661 473/270
7,527,562 B1 * 5/2009 Mason ..... A63B 69/3667 473/270
2010/0069168 A1 * 3/2010 Rhodes ..... A63B 69/3623 473/218
2011/0111876 A1 * 5/2011 Hart ..... A63B 53/14 473/257
2016/0038816 A1 * 2/2016 Taft ..... A63B 69/3623 473/218

* cited by examiner

*Primary Examiner* — Nini F Legesse
(74) *Attorney, Agent, or Firm* — Gulf Coast Intellectual Property Group

(57) ABSTRACT

A golf swing training device configured to be placed on the ground in front of a golfer during execution of the golf swing. The invention provides elements in order to assist the user in proper execution of a golf swing that includes but is not limited to shoulder turn and swing path during the downswing. The invention includes a first template that has a central aperture of suitable size to place a golf ball in the center thereof. The central aperture is defined by an inner perimeter edge and includes elements formed therealong. A left and right foot placement member indicate proper foot placement. A chin alignment member and shoulder turn target member are located on opposing sides of the central aperture. A first swing path target member and a second swing path target member are opposedly located across the central aperture with an axis therebetween for desired downswing path.

4 Claims, 2 Drawing Sheets

GOLF SWING TRAINING AID

PRIORITY UNDER 35 U.S.C SECTION 119(e) & 37 C.F.R. SECTION 1.78

This nonprovisional application claims priority based upon the following prior United States Provisional Patent Application entitled: Golf Swing Training Aid, Application No. 63/428,772 filed Nov. 30, 2022, in the name of Stacy Keisler, which is hereby incorporated by reference for all purposes.

FIELD OF THE INVENTION

The present invention relates to a golf swing training device, more specifically but not by way of limitation, a golf swing training aid that teaches a user how to properly move their body while executing the golf swing.

BACKGROUND

Millions of individuals around the world play golf on a regular basis. The sport of golf has existed for centuries and is steeped in tradition. As is known in the art, there are many facets to the game of golf. The game of golf can be divided into generally three segments of play. The first segment consists of the initial shot on a hole, which is traditionally referred to as a tee shot. This segment usually involves the use of a specialized golf club known as a driver. The next segment of a golf game can be generally categorized as fairway play. This segment is executed utilizing numerous different types of clubs that are all within the general category of golf clubs known as irons. The last segment of play involves the play on the golf course green.

The golf swing executed prior to the green is typically the same regardless whether the shot is a tee shot or a fairway shot. The swing mechanics for the swing of the aforementioned are the same. It is the consistent execution of the swing mechanics that will separate the good golfers from the below average golfers.

Accordingly, there is a need for a golf swing trainer that is configured to teach a golfer the proper body rotation when executing a golf swing.

SUMMARY OF THE INVENTION

It is the object of the present invention to provide a golf swing training aid configured to teach a golfer proper body rotation wherein the present invention includes a first template and a second template.

Another object of the present invention is to provide a swing training aid for golf wherein the first template of the present invention includes an annular shaped space having sufficient accommodation for a golf ball and tee to be placed in the middle thereof.

A further object of the present invention is to provide a golf swing training aid configured to teach a golfer proper body rotation wherein the second template includes an outline so as to provide guidance for placement of a user's foot.

Yet another object of the present invention is to provide a swing training aid for golf wherein the first template includes marking indicia along the perimeter of the central aperture thereof.

An additional object of the present invention is to provide a golf swing training aid configured to teach a golfer proper body rotation wherein the first template is configured to be utilized by a left-handed golfer and a right-handed golfer.

A further object of the present invention is to provide a golf swing training aid configured to teach a golfer proper body rotation wherein the first template of the present invention includes a left foot and a right foot placement member.

Another object of the present invention is to provide a golf swing training aid configured to teach a golfer proper body rotation wherein the first template includes a chin alignment member.

Still an additional object of the present invention is to provide a golf swing training aid configured to teach a golfer proper body rotation wherein the first template includes a shoulder turn alignment member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
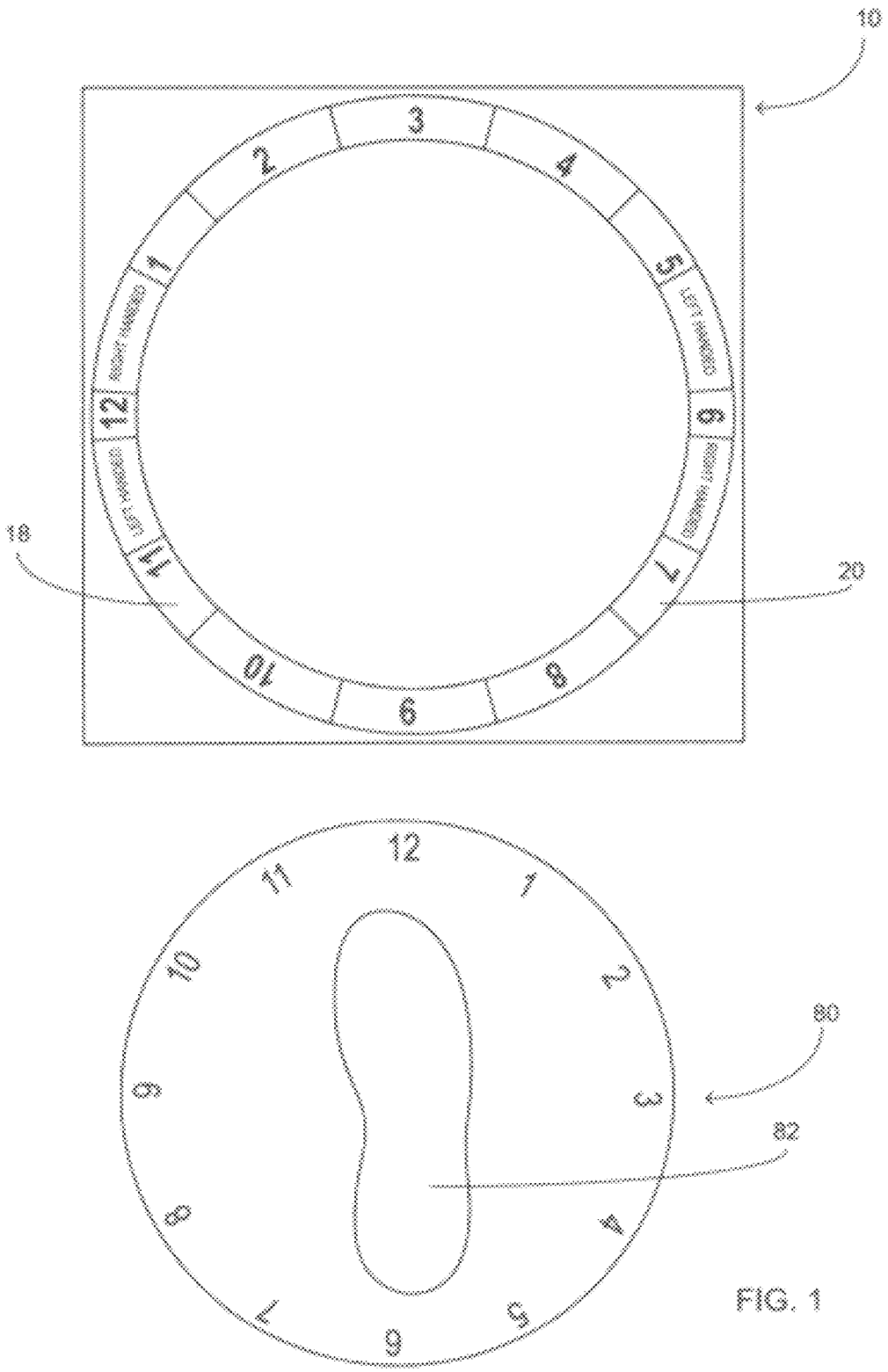
FIG. 1 is a top view of an embodiment of the present invention.
Figure 2:
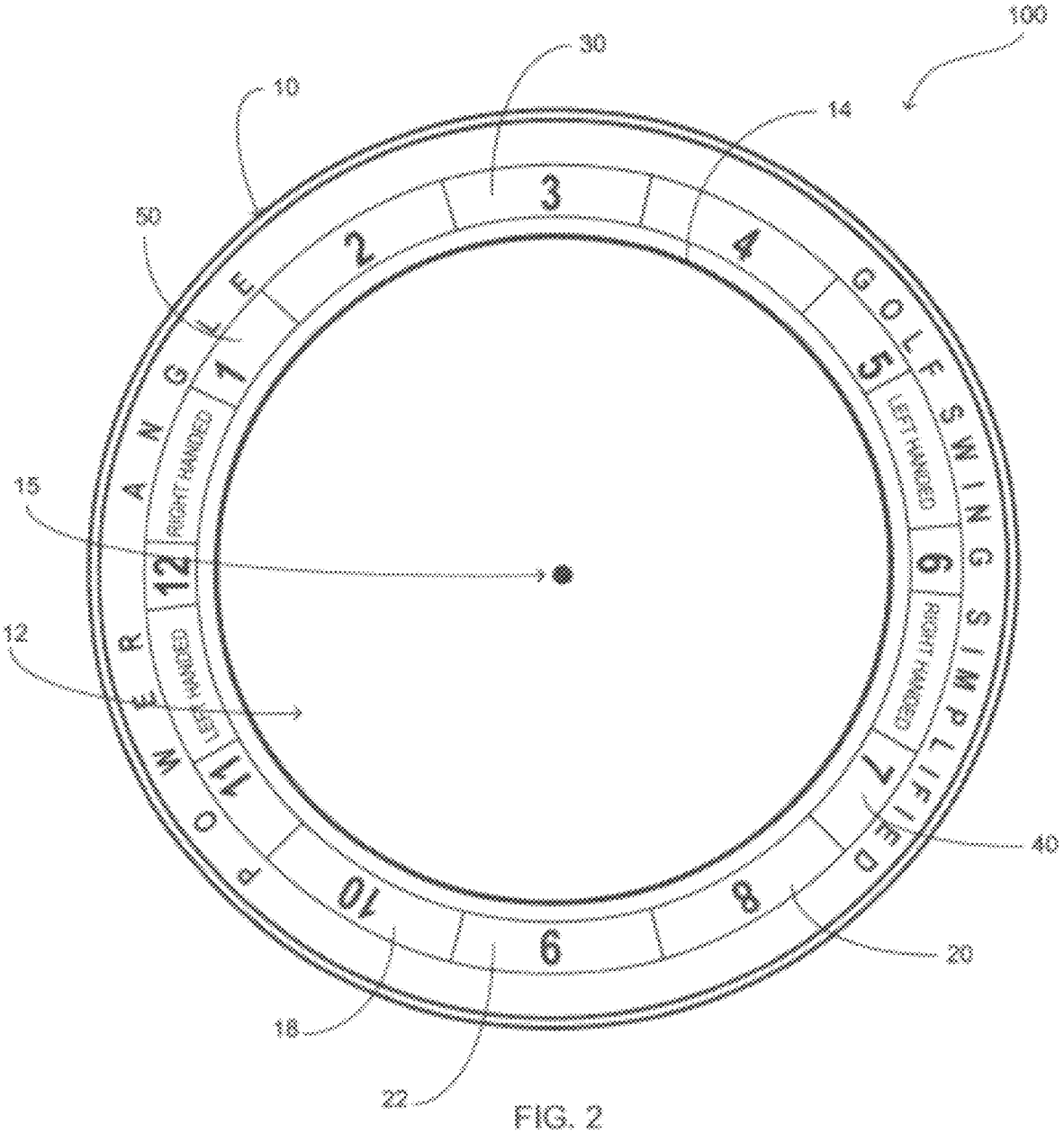
FIG. 2 is a top view of an alternate embodiment of the present invention.

Referring now to the drawings submitted herewith, wherein various elements depicted therein are not necessarily drawn to scale and wherein through the views and figures like elements are referenced with identical reference numerals, there is illustrated a golf swing training device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the golf swing training device 100 includes a first template 10 and a second template 80. The first template 10 and second template 80 are planar in manner and are configured to be superposed the ground. The first template 10 and second template 80 are manufactured from a suitable material such as but not limited to plastic. As is illustrated in the embodiments herein, it is contemplated within the scope of the present invention that the first template 10 could be provided in alternate shapes and sizes.

The first template 10 includes a central aperture 12 wherein the central aperture 12 is surrounded by the inner perimeter edge 14. The central aperture 12 is annular in shape and provides a sufficient void for placement of a golf ball approximately in the center thereof at the golf ball placement location 15. While the center aperture 12 is annular in shape in the drawings submitted herewith, it is contemplated within the scope of the present invention that the center aperture 12 could be provided in alternate shapes and sizes.

The first template 10 is placed so as to be in front of a user wherein the user will assume a golf swing stance position with the first template 10 in front of them on the ground. The foregoing discussion provides exemplary elements for a right-handed golfer but it should be understood that the first template 10 is configured to accommodate both a right-handed golfer and a left-handed golfer. All of the element members discussed herein have an identical counterpart so as to facilitate training for a left-handed golfer. The first template 10 includes a left foot placement member 18 and a right foot placement member 20 wherein the left foot placement member 18 and right foot placement member 20 are adjacent the inner perimeter edge 14. The left foot placement member 18 is formed on the first template 10 utilizing suitable durable techniques such as but not limited to printing. Similarly, the right foot placement member 20 is formed on the first template 10 utilizing printing or other suitable techniques. It is further contemplated within the scope of the present invention that the left foot placement member 18 and right foot placement member 20 could be elements that are releasably secured in the positions as illustrated herein employing suitable techniques. A user will place their left foot proximate and in general alignment with the left foot placement member 18 during use of the golf swing training device 100. The user will place their right foot proximate the right foot placement member 20 and be in general alignment therewith. While the left foot placement member 18 and right foot placement member 20 are illustrated herein as being numerical indicia, it is contemplated within the scope of the present invention that the left foot placement member and right foot placement member 20 could be alternate logos and/or elements instead of numerical indicia.

The first template 10 includes a chin alignment member 22. The chin alignment member 22 is intermediate the left foot placement member 18 and right foot placement member 20 along the inner perimeter edge 14. The chin alignment member 22 is formed on the first template 10 utilizing suitable techniques such as but not limited to printing. It is additionally contemplated within the scope of the present invention that the chin alignment member 22 could be an element that is releasably secured to the first template 10 employing suitable techniques. The chin alignment member 22 is employed by a user of the golf swing training device 100 to properly position their chin and as such their head during address of the golf ball prior to execution of a golf swing.

The golf swing training device 100 further includes a shoulder turn rotation target member 30. The shoulder rotation target member 30 is formed on the first template 10 utilizing suitable techniques such as but not limited to printing. The shoulder rotation target member 30 is located along the inner perimeter edge 14 opposite the chin alignment member 22 across the central aperture 12. The shoulder rotation target member 30 provides a location for a user of the golf swing training device 100 to focus on and turn their left shoulder and hip towards the shoulder rotation target member 30 during execution of the backswing of a golf swing during use of the golf swing training device 100. As with other elements of the golf swing training device 100 discussed herein, it should be understood within the scope of the present invention that the shoulder rotation target member 30 could be formed utilizing an element configured to be releasably secured to the first template 10 and additionally be displayed employing an alternate logo in place of and/or in conjunction with the numerical indicia illustrated herein.

The first template 10 includes a first swing path target member 40 and a second swing path target member 50 formed adjacent the inner perimeter edge 14 opposedly located across the central aperture 12. The first swing path target member 40 and second swing path target member 50 provide elements for a user of the golf swing training device 100 to direct their golf club along an axis intermediate thereto during execution of the downswing portion of the golf swing. The first swing path target member 40 and second swing path target member 50 are positioned on the first template 10 along the inner perimeter edge 14 in an orientation so as to direct a user of the golf swing training device 100 to properly execute the downswing portion wherein the path of the golf club in relation to the golf ball placement location is in a proper location to execute a desired ball flight of the golf ball. While the first swing path target member 40 and second swing path target member 50 are illustrated herein as imprinted numerical indicia, it is contemplated within the scope of the present invention that the first swing path target member 40 and second swing path target member 50 could be provided in alternate embodiments that are releasably secured to the first template 10.

The golf swing training device 100 further includes a second template 80 that is employed for additional foot placement guidance. The second template 80 is planar in manner including a central aperture 82 wherein the central aperture 82 is shaped so as to resemble an outline of a shoe. The second template 80 is placed proximate the first template 10 in a location that is rearward of the golf ball placement location 15. It should be understood that FIG. 1 herein does not illustrate placement of the second template

80 during use of the golf swing training device 100. The user of the golf swing training device 100 will place their right foot in the central aperture 82 wherein the second template 80 functions to guide the user of the golf swing training device 100 to place their right foot in the desired position for proper execution of a golf swing.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the claims.

What is claimed is:

1. A golf swing training device comprising:

a first template, said first template being planar in manner and configured to be superposed a ground surface, said first template having a central aperture, said central aperture being defined by an inner perimeter edge, said center aperture being of sufficient size to place a golf ball proximate a center thereof;

a left foot placement member, said left foot placement member being located adjacent said inner perimeter edge on said first template, said left foot placement member operable to provide guidance where to place a left foot of a user of the golf swing training device;

a right foot placement member, said right foot placement member being located adjacent said inner perimeter edge on said first template, said right foot placement member operable to provide guidance where to place a right foot of a user of the golf swing training device;

a chin alignment member, said chin alignment member being located adjacent said inner perimeter edge, said chin alignment member being intermediate said left foot placement member and said right foot placement member, said chin alignment member configured to provide an element for a user to axially align a chin therewith;

a first swing path target member, said first swing path target member being located adjacent said inner perimeter edge on said first template, said first swing path target member being adjacent said right foot placement member opposite said chin alignment member;

a second swing path target member, said second swing path target member being on said first template, said second swing path target member being located opposite said central aperture from said first swing path target member; and wherein said first swing path target member and said second swing path target member have an axis therebetween providing a desired swing path axis for a downswing portion of a golf swing.

2. The golf swing training device as recited in claim 1, and further including a shoulder rotation target member, said shoulder rotation target member being located adjacent said inner perimeter edge, said shoulder rotation target member being located opposite said chin alignment member across said central aperture, said shoulder rotation target member operable to indicate a direction and amount for a user to turn a shoulder during a backswing portion of a golf swing.

3. The golf swing training device as recited in claim 2, wherein the first template is configurable to be utilized by right-handed users and left-handed users.

4. The golf swing training device as recited in claim 3, and further including a second template, said second template operable to be placed proximate said first template, said second template having an aperture formed in a shape of a shoe, said aperture configured to have a user place a foot therein.

* * * * *